US006612140B1

(12) United States Patent
Strassell et al.

(10) Patent No.: US 6,612,140 B1
(45) Date of Patent: Sep. 2, 2003

(54) TRIGGER LOCK

(76) Inventors: Mike Strassell, 1015 Spingmill Rd., Mansfield, OH (US) 44906; Tom Deeb, 1015 Spingmill Rd., Mansfield, OH (US) 44906

( * ) Notice: Subject to any disclaimer, the term of this patent is extended or adjusted under 35 U.S.C. 154(b) by 0 days.

(21) Appl. No.: 09/573,810

(22) Filed: May 18, 2000

(51) Int. Cl.[7] ..... G05G 5/00

(52) U.S. Cl. ..... 70/203; 70/58; 42/70.07; 42/70.06; 42/70.11; 42/57; 42/58; 42/61; 248/552; 248/553; 248/551; 211/4; 211/8; 211/64

(58) Field of Search ..... 70/203, 58; 42/70.07, 42/70.06, 70.11, 57, 58, 61; 248/552, 553, 551; 211/4, 8, 64

(56) References Cited

U.S. PATENT DOCUMENTS

| | | | | | |
|---|---|---|---|---|---|
| 3,956,842 | A | * | 5/1976 | Ballenger | 42/1 Y |
| 4,030,221 | A | * | 6/1977 | Doobenen et al. | 42/1 Y |
| 4,198,026 | A | * | 4/1980 | Capolupo | 248/552 |
| 5,153,360 | A | * | 10/1992 | Upton | 42/70.11 |
| 5,392,552 | A | * | 2/1995 | McCarthy et al. | 42/70.07 |
| 5,417,000 | A | * | 5/1995 | Chen | 42/70.06 |
| 5,487,234 | A | * | 1/1996 | Dragon | 42/70.07 |
| 5,551,181 | A | * | 9/1996 | Upton | 42/70.11 |
| 5,832,647 | A | * | 11/1998 | Ling et al. | 42/70.07 |
| 6,134,822 | A | * | 10/2000 | Murgel | 42/70.07 |

* cited by examiner

*Primary Examiner*—William A. Cuchlinski, Jr.
*Assistant Examiner*—Ronnie Mancho
(74) *Attorney, Agent, or Firm*—Jerry Semer

(57) ABSTRACT

The invention is a lock for a gun that locks the trigger so it cannot be moved. The lock fits between the trigger and the trigger guard and keeps the trigger from moving. One of the unique features of the lock is that it can be locked both by a key and a padlock. The lock is comprised of two sections that in the preferred embodiment are made out of plastic which are attached together by a flexible strip of plastic and, thus, can be molded as a single piece. In approximately the middle of both sections is an opening. In this opening is placed the lock cylinder with a pin. From the end of the lock cylinder extends a loop with a sufficient size opening that a shackle of a padlock can be placed through it. To use the lock, one places the two sections together between the trigger and the trigger guard and then inserts the key into the lock cylinder and turns it. Once the pin falls in the proper location, the lock is securely held together between the trigger and trigger guard such that the trigger cannot be moved. This, of course, locks the gun. The loop that extends from the lock cylinder extends from the opening in the opposite section and past the edge of the opposite section sufficiently to allow the opening within the loop to extend out far enough that a shackle of a padlock can be placed through it. Thus, a padlock can be placed on the lock to provide additional security.

6 Claims, 5 Drawing Sheets

TRIGGER LOCK

FIELD OF THE INVENTION

The present invention relates to a firearms trigger lock and more particularly a lock that can be secured both by a key and a pad lock.

BACKGROUND OF THE INVENTION

Handguns are wide spread in the United States. Most of these guns are kept in people's homes mainly for their own protection. One problem plaguing society however, is the inadvertent discharge of such handguns. This usually occurs when a handgun is mishandled by an individual who is not familiar with a gun or familiar with the firing condition of the gun. Another problem in our society is children playing with guns in the home. Numerous children have been hurt in this country through playing with guns and the inadvertent firing of those guns. Thus, one of the objectives of this invention is to create a lock for the guns such that children cannot get the gun and inadvertently fire it. Thus, child proof the gun.

Another objective of this invention is to create this lock in such a way that it "child proofs" the gun; however, is easily accessible to adults for their protection. A third objective of this invention is to create a gun lock that can make the gun super secure for individuals wishing to pack the gun away for awhile.

There are numerous gun lock patents that the lock fits between the trigger and the trigger guard to insure that the trigger cannot be pulled. Some of these trigger locks like the ones shown in U.S. Pat. No. 5,400,538 to Shannon and U.S. Pat. No. 5,535,605 to Werner show these trigger locks that use a combination to open. The main problem with these is remembering the combination under a time of high stress when someone is trying to obtain the gun for their protection. A great number of other locks for triggers use keys. U.S. Pat. No. 3,368,297 to M. E. Lentz shows a safety lock that can use a key or even a pad lock that fits between the trigger and the trigger guard but also has a rod that runs up through the barrel. The problem with this lock is, of course, that it is reasonably cumbersome and hard to use. Thus, one of the objectives of the inventor's trigger lock is to make it simple and easy to use. U.S. Pat. No. 5,367,811 to Samsom, U.S. Pat. No. 4,198,026 to Capolupo, and U.S. Pat. No. 5,724,760 to Langner, all show locks that use pad locks. U.S. Pat. No. 4,198,026 shows an item that is placed in the trigger area of the gun and holds the trigger in place and does not allow it to move. This item is held in place with a pad lock. U.S. Pat. No. 5,367,811 shows a pad lock with a large enough shackles that it fits behind the trigger so the trigger cannot be moved rearward and the gun fire. U.S. Pat. No. 5,724,760 shows a plug that is placed behind the trigger and a pad lock is used to hold the plug in place similar U.S. Pat. No. 4,198,026. None of these locks show the lock that can be secured between the trigger and the trigger guard with a key and also allows for a padlock to be placed on the lock for extra protection. Thus, one of the objectives of this invention is to create a locking system that can be locked easily with a key and also more securely locked with a padlock.

The feature that makes this work is that the lock comes in two parts that are attached by a strip of plastic that easily bends to allow the two parts to be placed together. This allows the lock to be locked with a key and also lock with a padlock. This also enables the lock to be easily and cheaply manufactured in that it's two pieces of molded plastic and a few metal parts.

SUMMARY OF THE INVENTION

The invention is a lock for a gun that locks the trigger so it cannot be moved. The lock fits between the trigger and the trigger guard and keeps the trigger from moving. One of the unique features of the lock is that it can be locked both by a key and a padlock. The lock is comprised of two sections that in the preferred embodiment are made out of plastic which are attached together by a flexible strip of plastic and, thus, can be molded as a single piece. In approximately the middle of both sections is an opening. In this opening is placed the lock cylinder with a pin. From the end of the lock cylinder extends a loop with a sufficient size opening that a shackle of a padlock can be placed through it. To use the lock, one places the two sections together between the trigger and the trigger guard and then inserts the key into the lock cylinder and turns it. Once the pin falls in the proper location, the lock is securely held together between the trigger and trigger guard such that the trigger cannot be moved. This, of course, locks the gun. The loop that extends from the lock cylinder extends from the opening in the opposite section and past the edge of the opposite section sufficiently to allow the opening within the loop to extend out far enough that a shackle of a padlock can be placed through it. Thus, a padlock can be placed on the lock to provide additional security.

DETAILED DESCRIPTION OF THE PREFERRED EMBODIMENT

Figure 1:
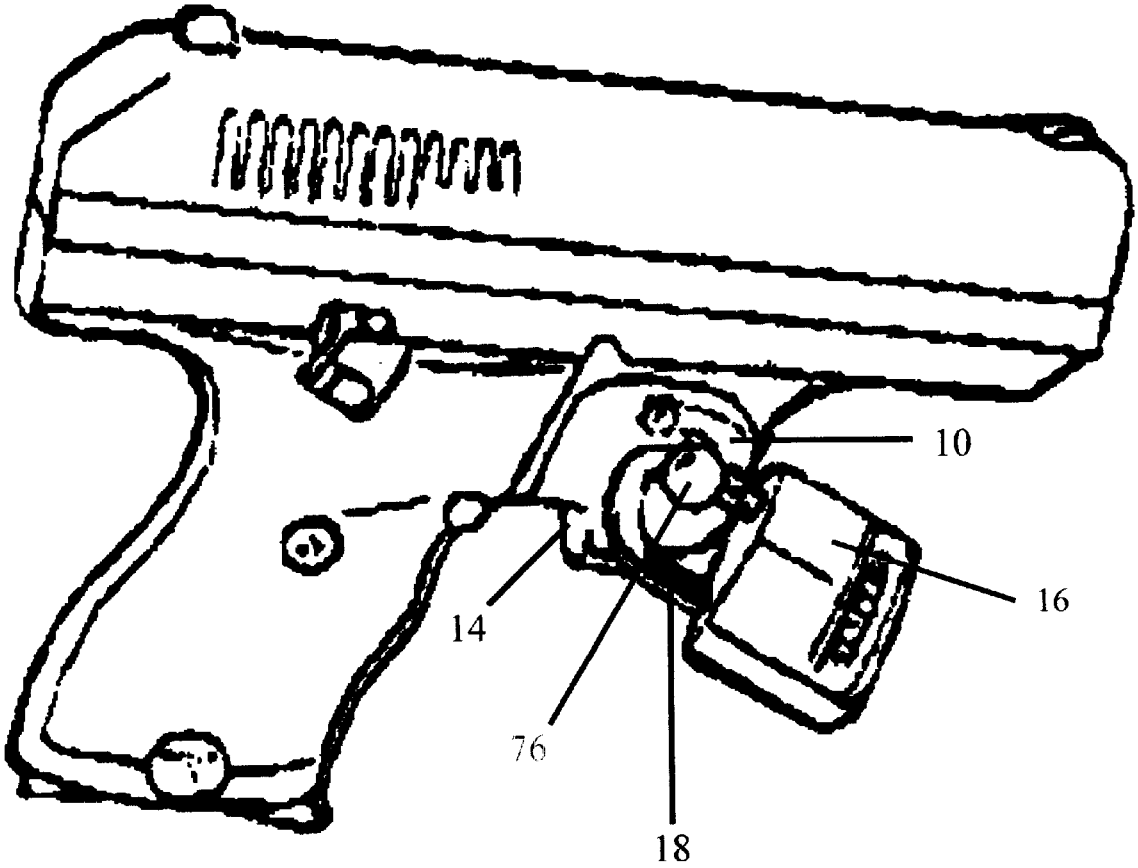
FIG. 1 is a view of the invention in place on a gun.

FIG. 1 shows the invention, gun lock, in position on the gun. The gun lock 10 fits between the trigger and the trigger guard 14; thus, the gun lock 10 is positioned such that the trigger cannot move and thus fire the gun. FIG. 1 also shows a padlock 16 whose shackle 18 fits through cap 76 which extends outward from the lock 10. The lock 10 can be locked in place between the trigger and the trigger guard 14 without the use of the padlock 16. However, to add additional security, one can place a padlock 16 on the lock 10.

Figure 2:
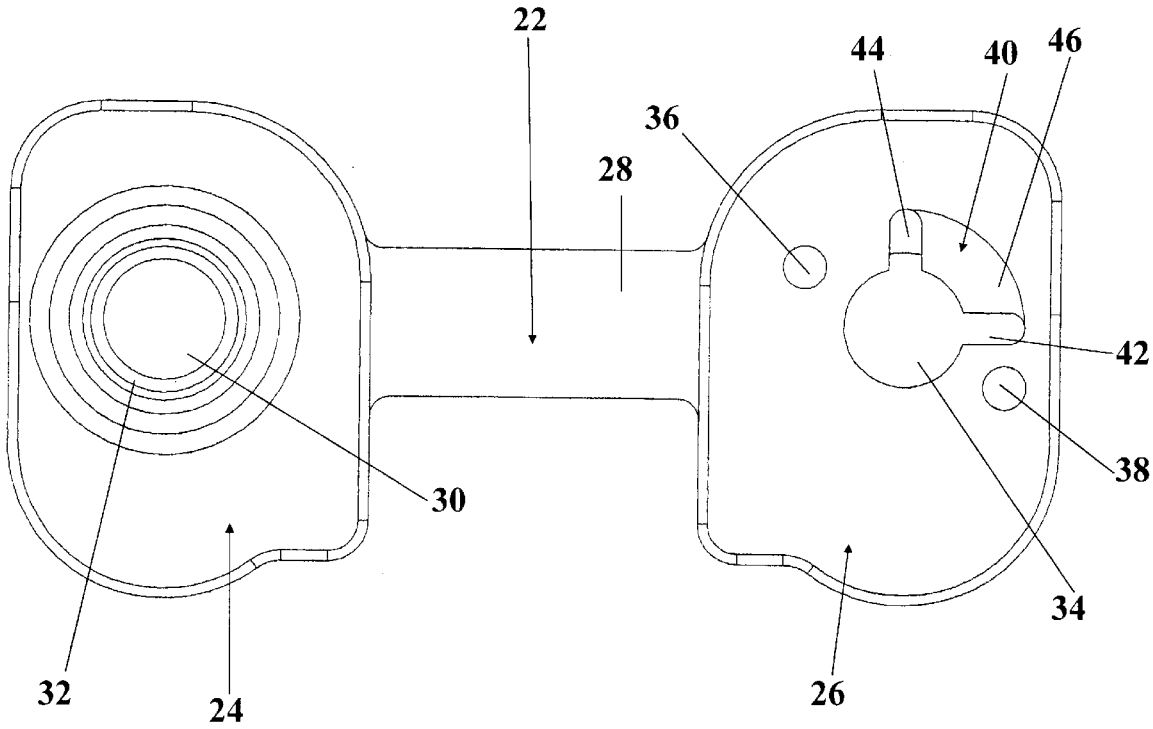
FIG. 2 is a front view of the main piece.

FIG. 2 is the front view of the main piece 22 of the invention. The main piece 22 comprises of a cylinder section 24 on one end and an opening section 26 on the other attached together by a flexible attachment strip 28. The flexible attachment strip 28 is made out of a flexible material that attaches to the cylinder section 24 and the opening section 26. In the preferred embodiment, the flexible attachment strip 28 and cylinder section 24 and the opening section 26 are all made out of plastic and are molded together. The flexible attachment strip 28 in the preferred embodiment is known in the industry as a living hinge. The flexible attachment strip 28 is flexible and thus the two sections 24 and 26 can be brought together. Both sections 24 and 26 contain an opening 30 and 34 in approximately the middle. The cylinder section 24, opening 30 extends completely through the cylinder section 24. Approximately half down through this opening 30 is a ridge 32. The opening section 26 also has an opening 34 in approximately its middle. This opening 34 is cylindrical and extends completely through opening section 26. On either side of opening 34 are holes 36 and 38 that extend completely through opening section 26. Extending from cylindrical opening 34 is a flared opening 40. This flared opening 40 fans out from the cylindrical opening 34 as shown in FIG. 2. The flared opening 40 does not extend completely through opening section 26. Approximately half way through section 26 there is a flared opening ridge 46 as shown in FIG. 2. At each end of flared opening ridge 46 are grooves 42 and 44. Unlock groove 42 extends completely through flared opening ridge 46. The locked groove 44 only extends partially into flared opening ridge 46.

Figure 3:
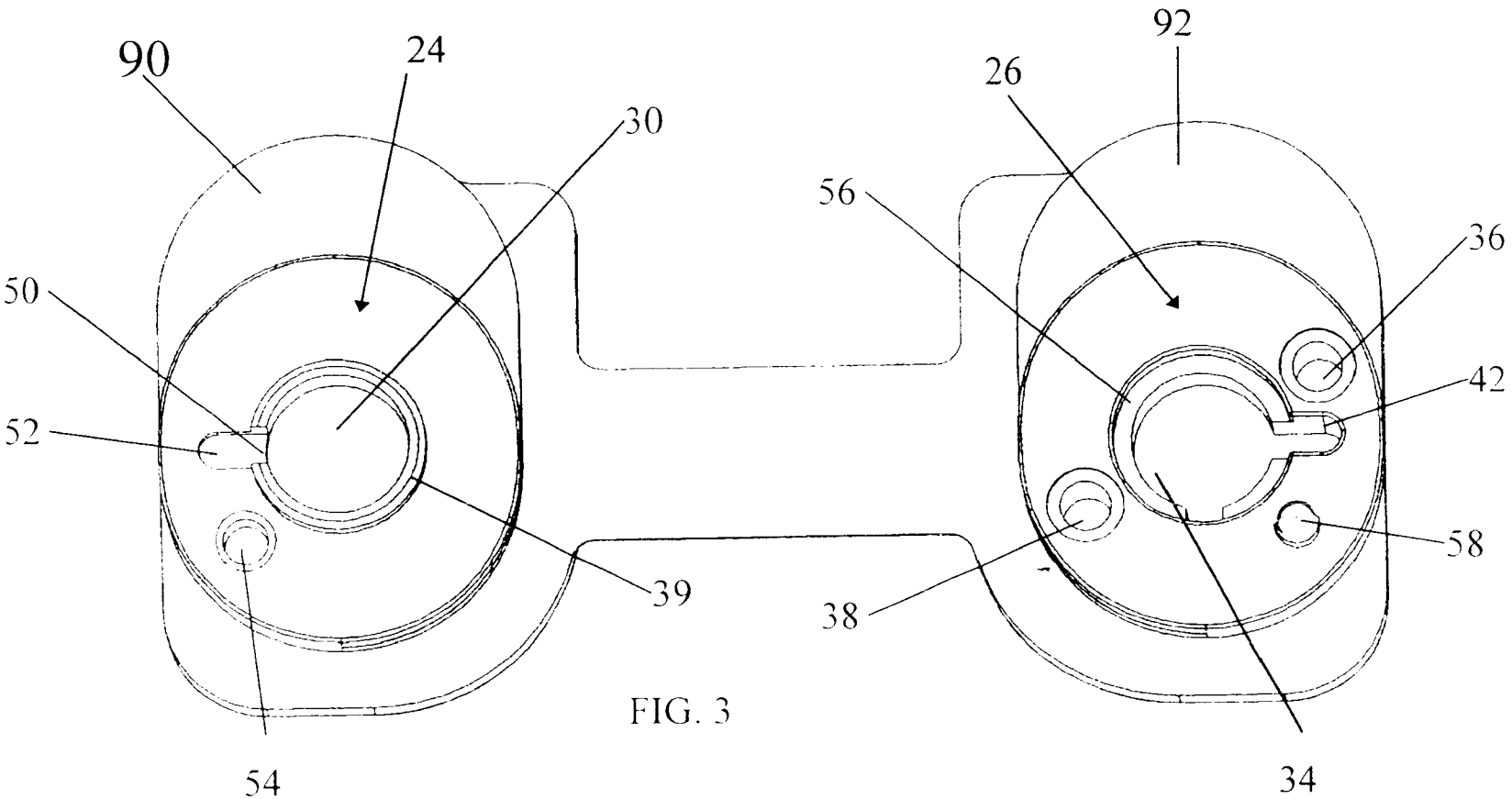
FIG. 3 is a back view of the main piece.

FIG. 3 shows the bottom view of the main piece 22. FIG. 3 shows the cylinder section 24 and the opening section 26. FIG. 3 also shows opening 30 and 34. Around opening 30, there is an annular ridge that extends upward from cylindrical section 24 and around opening 30. In ridge 39, there is a notch 50 that extends down into cylindrical section 24 and into a groove 52 the cylindrical section 24. Also on section 24 is an indent 54. On the opening section 26 there are two holes 36 and 38 that correspond to the two holes 36 and 38 on the other side of the opening section 26 since these holes 36 and 38 pass completely through opening section 26. Also, groove 42 in opening section 26 passes from the flared opening 40 on the other side of the opening section 26 to the back side of the opening section 26. In opening 34, there is a ridge that passes from groove 42 partially around opening 34. This ridge 56 starts approximately one-quarter of the way down the opening 34. This ridge 56 corresponds to the area of opening 34 that on the front side of section 26 is the cylindrical portion of opening 34 which does not contain the flared opening ridge 46. Also, in section 26, there is an indention 58 that extends partially through opening section 26.

Figure 4:
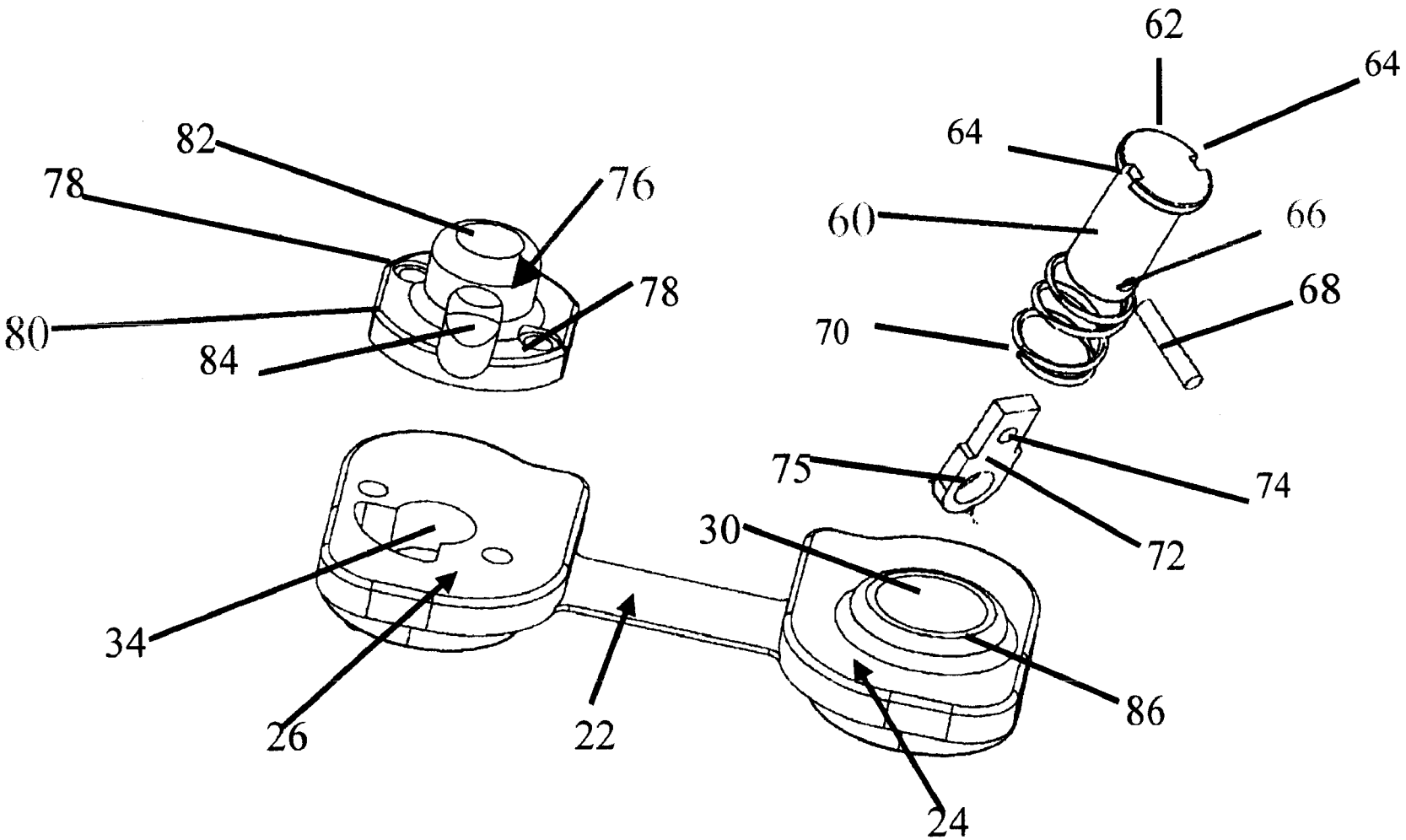
FIG. 4 is an exploded view of the invention.

FIG. 4 is an exploded view of the invention. In FIG. 4, one sees the main piece 22. Also in FIG. 4, one sees the pieces that fit through cylindrical section 24. This piece is the cylindrical piece 60. The cylindrical piece 60 is a cylinder with a ridge 62 on its top. The cylindrical piece ridge 62 has two grooves 64 in it. At the bottom of the cylindrical piece 60 is an opening 66. Within this opening 66 is fitted pin 68. A spring 70 is adapted to fit around cylindrical piece 60. The bottom of cylindrical piece 60 is a slot (not shown). Within this slot, loop piece 72 fits. Loop piece 72 is basically rectangular and is adapted to fit within the slot at the bottom of cylindrical piece 60. At one end of loop piece 72 is an opening 74. At the other end of loop piece 72 is loop 75 which is also shown on FIG. 4. As shown in FIG. 4, this pieces 72 that fit within opening 30 are assembled as follows: The spring 70 is placed on the cylindrical piece 60 up against the cylindrical piece ridge 62 which holds the spring 70 in place. Loop piece 72 is then placed in the slot in the bottom of cylindrical piece 60 with the opening 74 at the end opposite the loop 75 being placed within cylindrical piece 60. This opening 74 corresponds with the opening 66 in the cylindrical piece. The cylindrical piece 60 and the spring 70 with the loop piece 72 within are placed in opening 30 in the cylindrical section 24. Pressure is then placed on the top of the cylindrical piece 60 compressing the spring 60 until the loop 75 can be seen underneath cylindrical section 24. Loop 75 is of a sufficient size that a shackle 18 of a padlock can fit through it as shown in FIG. 1. The pin 68 is then placed in opening 66 and into loop piece 72 in opening 74. When pressure is released from cylindrical piece 60, the pin should seat itself in notch 50 and groove 52.

FIG. 4 shows over the opening section 26 is a cap 76. Cap 76 basically looks like a hat with two openings 78 within it. There are two brim openings 78 on the brim 80 of cap 76. On the top section 82 of cap 76 there is another large opening 84. This large opening 84 passes through the top section 82, thus, forming a large opening in the back of top section 82. This large opening 84 in the back of top section 82 is not shown in the drawings. This large opening 84 is of a sufficient size that a shackle 18 of a padlock can fit through it as shown in FIG. 1.

The cylindrical piece ridge 62 of the cylindrical piece 60 fits above the ridge 86 of the cylindrical section 24 when pin 68 is properly seated in notch 50 and groove 52.

FIG. 3 shows that the cylinder section 24 and the opening section 26 are basically round. However, at the top of cylindrical section 24, approximately half way down the side of cylindrical section 24 is a tongue 90 as shown in FIG. 3. Also on the opening section 26 at the top approximately half way down the side of opening section 26 is a tongue 92. The cap 76 is attached to the opening section 26 by placing rivets through openings 78 in the cap and openings 36 and 38 in opening section 26.

To use this lock, one places either the cylinder section 24 or the opening section 26 in the trigger guard 14 between the trigger guard 14 and the trigger. Then one places the other section against the previous section placed within the trigger guard 14. The indent 58 should fit in indent opening 54. The tongues 90 and 92 should cover the trigger. Thus, the trigger is fully covered and cannot be moved and thus the gun cannot be fired.

Figure 5:
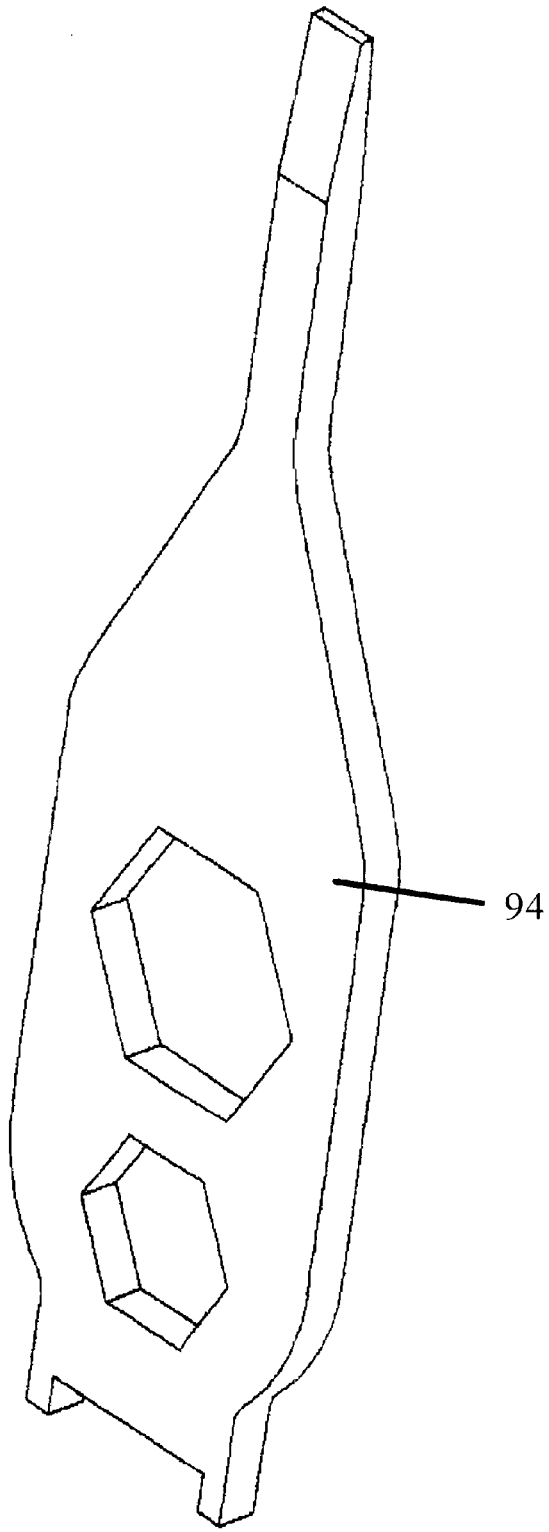
FIG. 5 is a view of the key.

The locking mechanism in this embodiment works as follows: As stated above, pin 68 is seated in notch 50 and groove 52. The pin 68 is held in place by spring 70 placing upward pressure on the cylinder piece 60 and pin 68. When one places key 94 as shown in FIG. 5 into the grooves 64 in the cylindrical piece 60 and places pressure on the cylindrical piece 60, the cylindrical piece 60 and pin 68 moves through grooves 42 in the opening section 26. The pin 68 moves to the flared opening ridge 46. Once pin 68 is above the flared opening ridge 46, the key 94 can be turned and the pin 68 moves across the flared opening ridge 46. The pin 68 then drops into a locked groove 44 and the spring 70 holds it in place and locks the gunlock 10.

Of course, there could be numerous other types of locking methods that could be used for this gunlock.

Changes and modifications in the specifically described embodiments can be carried out without departing from the scope of the invention which is intended to be limited only by the scope of the appending claims.

I claim:

1. A trigger lock comprising:

a) a first section adapted to fit between a trigger and a trigger guard of a gun and said first section has a tongue that covers said trigger when the first section is placed between the trigger guard and trigger; and b) a second section that is adapted to fit between the trigger and the trigger guard and said second section is adapted to seat in the first section and said second section has a tongue that covers the trigger when said second section is seated within said first section; and c) a flexible member whose first end attaches to the first section and whose second end attaches to the second section and said flexible member is of sufficient length that the second section can be brought around to seat within the first section when both sections are attached to the flexible member; and, d) a means for locking the first and second sections together such that the trigger cannot be moved.

2. A trigger lock as in claim 1 wherein:

a) the flexible member is a living hinge.

3. A trigger lock as in claim 1 wherein:

a) the first section and the second section and the flexible member are made out of a single piece of plastic.

4. A trigger lock as in claim 1 wherein:

a) the means for locking the two sections together between the trigger and the trigger guard is by a padlock.

5. A trigger lock as in claim 1 wherein:

a) the means for locking the two sections together between the trigger and the trigger guard is by a key lock.

6. A trigger lock as in claim 4 wherein:

a) the means for locking the two sections together between the trigger and the trigger guard is by a key lock.

* * * * *